US005620778A

United States Patent [19]

Clatworthy

[11] Patent Number: 5,620,778

[45] Date of Patent: Apr. 15, 1997

[54] CLAY TYPE LIQUID-RESISTANT PROTECTIVE LAYER

[75] Inventor: John Clatworthy, Harringay-London, Great Britain

[73] Assignee: Pharo Limited, Dublin, Ireland

[21] Appl. No.: 467,286

[22] Filed: Jun. 6, 1995

[30] Foreign Application Priority Data

Mar. 14, 1995 [BE] Belgium ..... 09500229

[51] Int. Cl.[6] ..... B32B 3/28; B09B 1/00; G21F 9/00

[52] U.S. Cl. ..... 428/167; 428/150; 428/192; 428/218; 405/129; 405/268; 52/169.14

[58] Field of Search ..... 428/150, 167, 428/156, 172, 81, 192, 218, 240, 242, 283, 913; 405/129, 258, 268, 270; 52/169.14, 169.5

[56] References Cited

U.S. PATENT DOCUMENTS 5,258,217 11/1993 Lewis ..... 428/120

5,360,294 11/1994 Carriker et al. ..... 405/270

FOREIGN PATENT DOCUMENTS

0522546A1 1/1993 European Pat. Off. .

4221329A1 5/1994 Germany .

OTHER PUBLICATIONS

Bouwwereld . vol. 88 No. 18, Sep. 4, 1992, p. 77 "Zelfdichtend Milieumembraan".

*Primary Examiner*—Donald Loney

*Attorney, Agent, or Firm*—Bacon & Thomas

[57] ABSTRACT

A liquid-resistant protective layer which at least consists of a material layer containing clay, has, adjacent at least one edge of the layer, at least one groove or slit which extends into the material layer containing the clay to enable sealed joints to be formed between contiguous protective layers.

9 Claims, 1 Drawing Sheet

CLAY TYPE LIQUID-RESISTANT PROTECTIVE LAYER

BACKGROUND OF THE INVENTION

The present invention concerns a liquid-resistant protective layer.

In particular it concerns a liquid-resistant protective layer basically formed of clay, in other words a clay mat.

Such clay mats are mainly used in water basins, canals and such as a sealing between the water and the ground; as a sealing between the water and the supporting structures in roof gardens, basements and such; as a sealing at waste dumping sites in order to avoid the penetration of rainwater and/or to prevent liquids from seeping through into the underlying ground; as a sealing in industrial installations such as tank parks, petrol stations, storage places, production units and such to prevent liquids from seeping through into the underlying ground, etc.

Such clay mats may De composed of a homogenous clay layer which is provided on either side with a coating, such as geofabric. This known embodiment is disadvantageous in that the clay can easily move between or come off the textile layers, such that micro-cracks or fissures may arise where liquid can seep through, and in that the clay can drop from between the textile layers at the edges when cutting such clay mats.

In order to remedy this disadvantage, a liquid-resistant layer has already been developed which consists of a compact layer made of a clay mass reinforced with fibres, which may or may not be provided with a coating.

Although such a liquid-resistant layer offers a solution to said disadvantage, such clay reinforced with fibres has another disadvantage, namely in that it has a negative effect on the self-sealing qualities in those places where such liquid-resistant layers overlap. Due to the good cohesion of reinforced clay, only little clay will migrate to the overlap, so that the clay sealing in the overlap zone is threatened.

This negative effect is often reinforced by the fact that the fibre density is usually greater at the surfaces of the layer containing the clay than in the middle part of this layer. Accordingly, on the one hand, there will be less clay at the surfaces and the migration of clay to the overlap will only be limited, or, on the other hand, a sort of wick effect is created, such that the ends of the fibres protrude from the layer concerned and thus form capillary passages in the overlap zone, where the water or such is in effect sucked through, like liquid through a wick.

Also, the present invention aims a liquid-resistant protective layer with which said disadvantage can be excluded.

SUMMARY OF THE INVENTION

To this aim, the invention consists of a liquid-resistant protective layer which at least consists of a material layer containing clay, characterized in that it has, within the range of at least one edge, at least one groove or slit which extends in the material layer containing the clay.

The grooves or slits make it possible for the clay to come off more easily from the neighbourhood of these grooves and so migrate easily via these grooves to the overlap, so that finally a perfect sealing is obtained.

BRIEF DESCRIPTION OF THE DRAWINGS

In order to better explain the characteristics of the invention, the following preferred embodiment is described as an example only without being limitative in any way, with reference to the accompanying drawings, in which.

DETAILED DESCRIPTION

Figure 1:
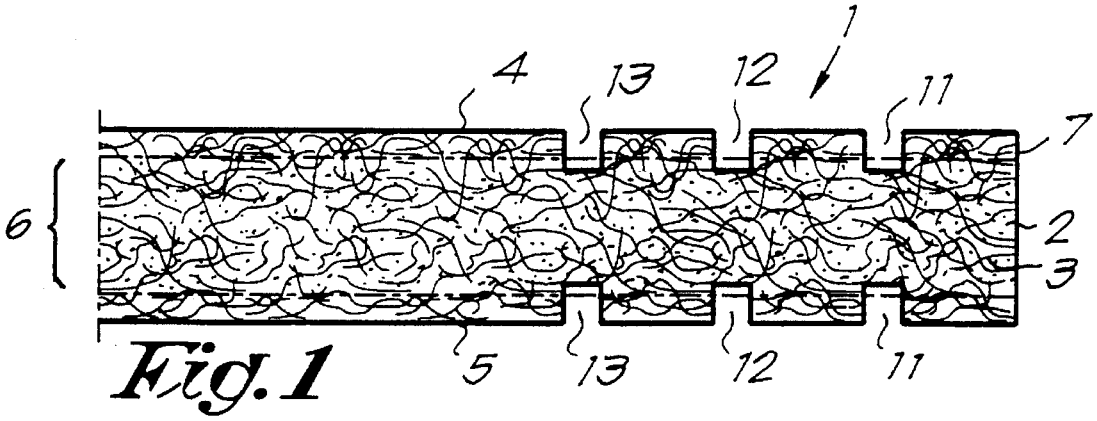
FIG. 1 shows a section of the perimeter of a liquid-resistant protective layer.
Figure 2:
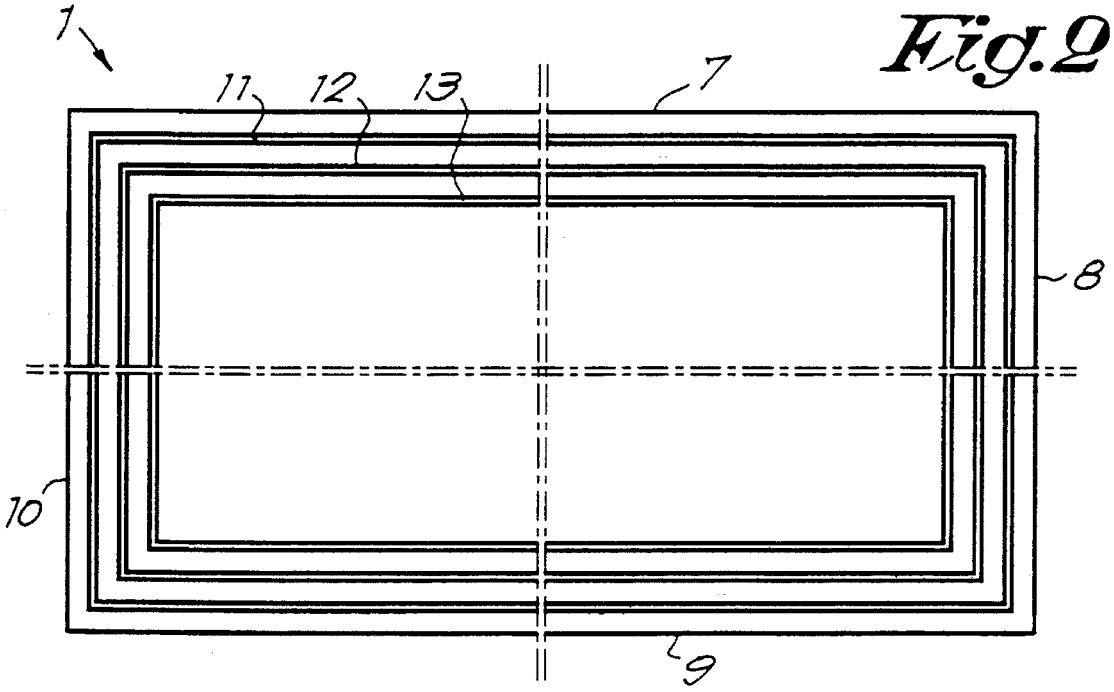
FIG. 2 shows a top view of the liquid-resistant protective layer according to FIG. 1.

As shown in FIGS. 1 and 2, the invention concerns a liquid-resistant protective layer 1, in particular a protective layer which at least consists of a material layer containing clay 2.

In the example shown, a material layer has been taken which in fact is a compact layer made of a fibre mass 3 filled with the above-mentioned clay 2.

With such a construction, the fibre mass, as mentioned in the introduction, can have a greater fibre density at the surfaces 4, 5 respectively than in the middle part 6.

The invention is unique in that the liquid-resistant protective layer 1 has, within the range of at least one edge 7, 8, 9 or 10 at least one groove, or better still, as represented in FIGS. 1 and 2, several grooves, in this case three grooves 11, 12 and 13, which extend in the material layer containing the clay.

As represented in FIG. 1, such grooves 11–12–13 may be provided both at the top side and at the bottom side of the protective layer 1, although in principle, it is sufficient to provide them at one side of the protective layer 1.

Such groove 11, 12 or 13 may be formed by a simple cut or by removing material from a specific zone, for example in the shape of a groove.

As represented in FIG. 2, each of the grooves 11, 12 or 13 preferably extends uninterruptedly along the edge 7–8–9–10, and preferably even along the entire perimeter of the protective layer 1.

In the case where use is made of several grooves, as is the case in the illustrated example, they should be preferably situated parallel to one another.

The grooves 11–12–13 are preferably provided in the fabricating plant by means of mechanical, ultrasonic or high-frequency cutting of the material part, or possibly by cutting material parts by means of a laser beam.

Figure 3:
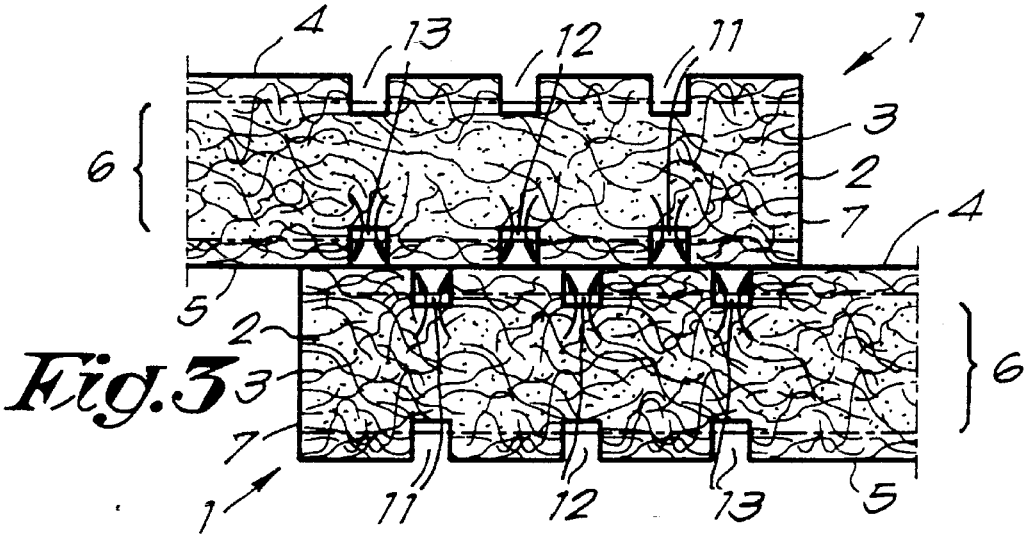
FIG. 3 shows the overlap area of two liquid-resistant protective layers according to the invention.

FIG. 3 shows how a good sealing is obtained according to the invention at an overlap of two protective layers 1.

As shown in FIG. 3 by means of arrows, the clay 2 can now easily migrate to the overlap via the above-mentioned grooves 11–12–13, whereby even clay from the above-mentioned middle area 6 can be released and can penetrate in the overlap zone.

It is clear that different variants are possible within the scope of the invention.

Although the invention is particularly useful for protective layers 1 having a material layer made of a fibre mass filled with clay, it is clear that the invention can also be used for protective layers based on clay which do not have any fibre mass.

It is also possible to use the invention for protective layers 1, with a material layer based on clay, whereby other coatings are provided along said material layer. Naturally, the grooves 11, 12 and 13, are in this case made such that they extend through the coatings concerned and such that they penetrate at least partially into the material layer containing the clay.

In the case where the protective layer is made in the shape of a rollable strip, one or several grooves will be preferably provided on either side of this strip only.

In the case where, as represented in FIG. 1, grooves are provided both at the top side and at the bottom side, they can be provided at different places in the horizontal sense, so that the protective layer 1 is weakened as little as possible locally.

It is clear that the present invention is by no means limited to the above-described embodiments represented in the accompanying drawings; on the contrary, such a liquid-resistant protective layer can be made in various shapes and dimensions while still remaining within the scope of the invention.

I claim:

1. A liquid-resistant protective layer having opposed outer surfaces intersecting at least one edge and which at least includes a material layer containing clay, comprising at least one groove extending on at least one of said surfaces generally along said at least one edge of the layer and extending into the material layer containing the clay.

2. The liquid-resistant protective layer according to claim 1, wherein the material layer containing the clay comprises a compact layer formed of a fibre mass filled with clay.

3. The liquid-resistant protective layer according to claim 2, wherein the density of fibre in said clay-containing material is greater towards the outer surfaces of the layer than in the central portion thereof, and wherein said at least one groove extends into said central portion.

4. The liquid-resistant protective layer according to claim 1, wherein said at least one groove comprises a slot.

5. The liquid-resistant protective layer according to claim 1, wherein said at least one groove extends uninterruptedly along said at least one edge of said protective layer.

6. The liquid-resistant protective layer according to claim 1, wherein said at least one edge defines a perimeter for the protective layer and wherein said at least one groove extends along the entire perimeter of said protective layer.

7. The liquid-resistant protective layer according to claim 1, wherein said at least one groove comprises at least one groove disposed on one of said opposed surfaces and at least one groove disposed on the other opposed surface of the protective layer, each groove extending adjacent and generally along said at least one edge of the layer.

8. The liquid-resistant protective layer according to claim 7, wherein said at least one groove on the opposed surfaces comprises a plurality of generally adjacent grooves, wherein each groove of each plurality of grooves is spaced at a different distance from said at least one edge.

9. The liquid-resistant protective layer according to claim 1 wherein said at least one groove has been formed by cutting means selected from one of mechanical, ultrasonic, high-frequency and laser beam cutters.

* * * * *